US008185363B2

(12) United States Patent
Barjot et al.

(10) Patent No.: US 8,185,363 B2
(45) Date of Patent: May 22, 2012

(54) SYSTEM AND METHODS FOR DETERMINING SIZE, AND METHOD FOR PRODUCING A SIZE-DETERMINING SYSTEM

(75) Inventors: Nicolas Barjot, Terville (FR); Nicolas Belluye, Lille (FR)

(73) Assignee: Decathlon, Villeneuve d'Ascq (FR)

( * ) Notice: Subject to any disclaimer, the term of this patent is extended or adjusted under 35 U.S.C. 154(b) by 863 days.

(21) Appl. No.: 11/997,937

(22) PCT Filed: Aug. 7, 2006

(86) PCT No.: PCT/FR2006/001915

§ 371 (c)(1),
(2), (4) Date: Aug. 8, 2008

(87) PCT Pub. No.: WO2007/017592

PCT Pub. Date: Feb. 15, 2007

(65) Prior Publication Data

US 2009/0125281 A1 May 14, 2009

(30) Foreign Application Priority Data

Aug. 5, 2005 (FR) ..... 05 08394

(51) Int. Cl.
*G06G 7/48* (2006.01)
*G06G 7/60* (2006.01)
*G06F 19/00* (2006.01)

(52) U.S. Cl. ..... 703/6; 703/2; 700/132

(58) Field of Classification Search ..... 703/2, 6; 700/132

See application file for complete search history.

(56) References Cited

U.S. PATENT DOCUMENTS 5,757,661 A * 5/1998 Surville ..... 702/155
5,764,332 A * 6/1998 Kranhouse ..... 351/43

FOREIGN PATENT DOCUMENTS

FR 2707120 1/1995
FR 2843684 2/2004

OTHER PUBLICATIONS

DeCarlo et al. "An Anthropometric Face Model using Variational Techniques", Proceedings SIGGRAPH'98., 1988. pp. 67-74.*
Han et al. "Development of Prototypes of Half-Mask Facepieces for Koreans Using the 3D Digitizing Design Method: A Pilot Study". Oxford University Press., 2004. pp. 707-714.*
International Search Report PCT/FR2006/001915.

* cited by examiner

*Primary Examiner* — Paul Rodriguez
*Assistant Examiner* — Eunhee Kim
(74) *Attorney, Agent, or Firm* — Ladas & Parry LLP

(57) ABSTRACT

The invention concerns a size-determining system and method of size grading type, used in particular to determine sizes, and a method to produce the system for a product to be worn on parts of the body. The method to produce the system includes selecting principal morphological parameters from among parameters corresponding to the distance between two morphological markers characteristic of the body part and selecting product parameters, determining an arithmetical relationship between each product parameter and the principal morphological parameters, and determining sizes defined by particular variation intervals of the principle morphological parameters or product parameters. The system stores values of the morphological parameters and product parameters and includes a module to calculate the value of the product parameters in relation to the value of the principal morphological parameters.

16 Claims, 6 Drawing Sheets

SYSTEM AND METHODS FOR DETERMINING SIZE, AND METHOD FOR PRODUCING A SIZE-DETERMINING SYSTEM

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION (1) Field of the Invention

The subject of this present invention is a size-determining system and method, as well as a method for the producing of a size-determining system. It finds particular application in the field of creating a sizing system for products that are intended to be worn on one or more parts of the body of a person. For example, but not exclusively, it can consist of articles for sub-aquatic vision, in particular such as swimming goggles, and swimming or diving masks.

(2) Description of Related Art

In general, a product is offered for sale either in a single size or in several sizes.

When offered in a single size, it is obviously understood that the product will not necessarily be suitable for all users. A size, regardless of its definition, is generally determined statistically so that it will fit the greatest number. But the satisfaction rating, which is related to suitability of fit, will be relatively low, given the different possible morphology types, and the morphological differences within a given morphology type.

The problem is particularly difficult for products such as items for sub-aquatic vision e.g. swimming goggles, and swimming or diving masks. For such products, there is an important issue of comfort and leak-resistance properties. It is extremely difficult to design a product in a single size that affords a satisfactory level of comfort and leak-tightness for a large number of people, since face morphology differences can vary widely from one person to another.

Under these conditions, to improve the level of comfort of the product it is possible, for example, to include a foam gasket that follows the contour of the user's face as closely as possible to compensate for the poor fit of the single size. The problem then arises of poor leak-proof qualities due to this type of gasket.

Conversely, to achieve good leak resistance properties, it is possible to provide the product with a silicone gasket, since this will provide a better level of leak-tightness than a foam gasket. However the problem then will be a problem of discomfort for a certain number of users for whom the single size is ill-adapted.

It can therefore be appreciated that a product that is offered to users in several sizes will satisfy a greater number thereof.

Systems and methods known as size grading are already known for clothing, which are used to determine the characteristics of a certain number of sizes from a master pattern.

For this master pattern, the geometrical characteristics of all parts of the garment are determined. Then, using empirical grading rules, particular to the garment under consideration and applied to the characteristic points of the garment, the characteristics of the other sizes are obtained. These rules concern variations in the coordinates of the characteristic points.

These systems and methods are complex and expensive however. They necessitate extensive calculations, based on empirical rules that are not necessarily appropriate. Additionally, they are not appropriate for products whose geometry or morphology does not directly reflect that of the part of the body on which these products are to be worn. In some cases, the correlation between the different geometries of certain parts of the body for a given size, and these same geometries for a different size is not necessarily a logical correlation.

This is the case, for example, with products such as items for sub-aquatic vision e.g. swimming goggles, and swimming or diving masks. In this case, these systems and methods do not allow a relationship to be established between certain morphological characteristics of the product and certain morphological characteristics of that part of the body on which the product is to be worn, nor do they allow a size to be determined, from among a set of possible sizes, that is best suited a given person.

The problem which therefore arises is the providing of a system and a method, based on a set of size parameters characteristic of the products, which can be used in particular to determine sizes having a high level of morphological coverage, so as to be able to determine the size, from among a group of possible sizes, that will fit an individual person.

The objective of the invention is therefore to provide a solution to the aforementioned problems, amongst others.

BRIEF SUMMARY OF THE INVENTION

According to a first aspect therefore, the invention relates to a method to produce a sizing system for an item that is intended to be worn on at least one part of the body.

Characteristically, the method firstly includes a step to select one or more principal morphological parameters $PMP_{i,j}$ from among one or more characteristic morphological parameters $PM_{i,j}$ of that part of the body, and corresponding to the distance between two characteristic morphological markers $M_i$, $M_j$ of this part of the body.

The method also includes a step to select at least one product parameter $PP_{i,j}$ corresponding to the distance between two points $NP_i$, $NP_j$ that are geometrically characteristic of the product, and a first determination step to determine an arithmetical relationship between each product parameter $PP_{i,j}$ and at least one of the principal morphological parameters $PMP_{i,j}$.

It also includes a second determination step to determine an arithmetical relationship between the coordinates of each geometrically characteristic point $NP_i$ of the product and at least one of said product parameters $PP_{i,j}$, these coordinates being expressed in a reference system centred on one particular point $NP_{ref}$ from among the geometrically characteristic points $NP_i$ of the product.

The method finally includes a step to determine one or more sizes, each of these sizes being determined by particular intervals of variation of the principal morphological parameter or parameters $PMP_{i,j}$ respectively, or by particular intervals of variation of the product parameter or parameters $PP_{i,j}$ respectively.

In a first variant, the first step to determine an arithmetical relationship between each product parameter $PP_{i,j}$ and at least one of the principal morphological parameters $PMP_{i,j}$, for each product parameter $PP_{i,j}$, includes a step to determine arithmetical coefficients $c^0_{i,j}$ $c^n_{i,j}$, such that:

$$PP_{i,j}=c^0_{i,j}+c^1_{i,j}\times PMP_{i1,j1}+c^2_{i,j}\times PMP_{i2,j2}+\ldots c^n_{i,j}\times PMP_{in,jn}$$

In a second variant, optionally in combination with the preceding variant, the first step to determine an arithmetical relationship between each product parameter $PP_{i,j}$ and at least one of the principal morphological parameters $PMP_{i,j}$ itself includes a first step for determining an arithmetical relationship between each morphological parameter $PM_{i,j}$ and at least one of the principal morphological parameters $PMP_{i,j}$, and a second step to determine an arithmetical relationship between each product parameter $PP_{i,j}$ and at least one of the morphological parameters $PM_{i,j}$.

The first step to determine an arithmetical relationship between each morphological parameter $PM_{i,j}$ and at least one of the principal morphological parameters $PMP_{i,j}$, preferably then includes, for each morphological parameter $PM_{i,j}$, a step to determine arithmetical coefficients $d^0_{i,j}, \ldots, d^n_{i,j}$, such that:

$$PM_{i,j}=d^0_{i,j}+d^1_{i,j}\times PMP_{i1,j1}+d^2_{i,j}\times PMP_{i2,j2}+\ldots +d^n_{i,j}\times PMP_{in,jn}$$

Also preferably, the second step to determine an arithmetical relationship between each product parameter $PP_{i,j}$ and at least one of the morphological parameters $PM_{p,q}$, for each product parameter $PP_{i,j}$, includes a step to determine an arithmetical coefficient $e^{p,q}_{i,j}$ such that:

$$PP_{i,j}=e^{p,q}_{i,j}\times PM_{p,q}$$

In another variant, optionally in combination with any one or more of the preceding variants, the variation intervals of the product parameters $PP_{i,j}$ are defined by a tolerance that equal to or less than ±4%, and preferably equal to ±3%, around a median value.

In another variant, optionally in combination with any one or more of the preceding variants, the part of the body being the face, the morphological parameters $PMP_{i,j}$ are the biectocanthion distance, the biendocanthion distance, and the distance from the nasion to the subnasal point.

The following definitions are recalled. The ectocanthions are the points located at the external (lateral) palpebral angles, on the posterior ridge, and the biectocanthion distance is therefore the distance between the two ectocanthions of the face. The endocanthions are the points located at the internal (median) palpebral angles, outside of the lachrymal caruncle, and the biendocanthion distance is therefore the distance between the two endocanthions of the face. The nasion is the median point located at the junction of the root of the nose and the forehead. Finally, the subnasal point is the point located at the apex of the angle formed by the lower edge of the septum and the top lip.

In yet another variant, optionally in combination with any one or more of the preceding variants, the product 1 is an item for sub-aquatic vision.

According to a second aspect, the invention also relates to a sizing system for a product that is intended to be worn on at least one part of the body.

Characteristically, the system includes means to store the respective values of one or more characteristic morphological parameters $PM_{i,j}$ of the part of the body, which correspond to the distance between two characteristic morphological markers $M_i$, $M_j$ of that part of the body, at least one of these morphological parameters $PM_{i,j}$ being a principal morphological parameter $PMP_{i,j}$.

The system also includes means to store the respective values of one or more product parameters $PP_{i,j}$ geometrically characteristic of the product, and corresponding to the distance between two geometrically characteristic points $NP_i$, $NP_j$ of the product, and a first module to calculate the value of each product parameter $PP_{i,j}$ in relation to the value of at least one of the principal morphological parameters $PMP_{i,j}$.

It also includes a second module 6 to calculate the value of the coordinates of each geometrically characteristic point $NP_i$ of the product, in relation to at least one of the product parameters $PP_{i,j}$, these coordinates being expressed in a reference system centred on a particular point $NP_{ref}$ from among the geometrically characteristic points $NP_i$ of the product.

Finally, the system includes means to store at least one size determined by particular variation intervals of the respective principal morphological parameter(s) $PMP_{i,j}$, or by particular variation intervals of the respective product parameter(s) $PP_{i,j}$.

In a first variant, the first calculation module is designed to perform the following calculation for each product parameter $$PP_{i,j}=c^0_{i,j}+c^1_{i,j}\times PMP_{i1,j1}\times c^2_{i,j}\times PMP_{i2,j2}+\ldots +c^n_{i,j}\times PMP_{in,jn}$$

where $c^0_{i,j}, \ldots, c^n_{i,j}$ are predefined arithmetical coefficients.

In another variant, optionally in combination with the preceding variant, the first module to calculate the value of each product parameter $PP_{i,j}$ in relation to the value of at least one of said principal morphological parameters $PMP_{i,j}$ itself includes a first sub-module to calculate the value of each morphological parameter $PM_{i,j}$ in relation to the value of at least one of the principal morphological parameters $PMP_{i,j}$, and a second sub-module to calculate the value of each product parameter $PP_{i,j}$ in relation to the value of at least one of the morphological parameters $PM_{i,j}$.

The first calculation sub-module is then preferably designed to perform the following calculation for each morphological parameter $PM_{i,j}$:

$$PM_{i,j}=d^0_{i,j}+d^1_{i,j}\times PMP_{i1,j1}+d^2_{i,j}\times PMP_{i2,j2}+\ldots +d^n_{i,j}\times PMP_{in,jn}$$

where $d^0_{i,j}, \ldots, d^n_{i,j}$ are predefined arithmetical coefficients.

Again preferably, the second calculation sub-module is designed to perform the following calculation for each product parameter $PP_{i,j}$: $PP_{i,j}=e^{p,q}_{i,j}\times PM_{p,q}$ where $e^{p,q}_{i,j}$ is a predefined arithmetical coefficient.

In another variant, optionally in combination with any one or more of the preceding variants, the product being intended to be worn on at least one part of the body of a given person, the system includes means to determine the value of the principal characteristic morphological parameter(s) $PMP_{i,j}$ of that part of the body of this given person.

It then also includes means for comparing the value of the principal characteristic morphological parameter(s) $PMP_{i,j}$ of that part of the body of the given person, with the respective limits of the variation intervals determining each of the sizes of the group of sizes stored in the size storage means.

It finally includes means to select the size, from among all the sizes, which is defined by one or more variation intervals covering the respective values of the principal characteristic morphological parameter(s) $PMP_{i,j}$ of that part of the body of the given person.

In yet another variant, optionally in combination with any one or more of the preceding variants, the variation intervals of the product parameters $PP_{i,j}$ are defined with a tolerance equal to or less than ±4%, and preferably equal to ±3%, around a median value.

In yet another variant, optionally in combination with any one or more of the preceding variants, the part of the body being the face, the principal morphological parameters $PMP_{i,j}$ are the biectocanthion distance, the biendocanthion distance, and the distance from the nasion to the subnasal point, whose respective definitions are recalled above.

In yet another variant, optionally in combination with any one or more of the preceding variants, the product is an item for sub-aquatic vision.

Finally, according to a third aspect, the invention relates to a method for the sizing of a product that is intended to be worn on at least one part of the body.

Characteristically, the method includes a step to select one or more principal morphological parameters $PMP_{i,j}$ from among one or more characteristic morphological parameters $PM_{i,j}$ of the part of the body, and corresponding to the distance between two characteristic morphological markers $M_i$, $M_j$ of this part of the body.

It also includes a first step to calculate the value of one or more production parameters $PP_{i,j}$ of the product, corresponding to the distance between two points $NP_i$, $NP_j$, in relation to the respective values of one or more characteristic principal morphological parameters $PMP_{i,j}$ of the part of the body.

The method also includes a second step to calculate the value of the coordinates of each geometrically characteristic point $NP_i$ of the product, in relation to the respective values of one or more production parameters $PP_{i,j}$ of the product, these coordinates being expressed in a reference system centred on a particular point $NP_{ref}$ from among the geometrically characteristic points $NP_i$ of the product.

Finally, it includes a step to determine the respective values of the principal morphological parameter(s) $PMP_{i,j}$ by selecting a given size from among a group of sizes defined by respective variation intervals of the principal morphological parameter(s) $PMP_{i,j}$, and by assigning the median value of each of the variation intervals defining the given size to each corresponding principal morphological parameter $PMP_{i,j}$.

In a first variant, for each production parameter $PP_{i,j}$ of the product, the first calculation step performs the following calculation:

$$PP_{i,j}=c^0_{i,j}+c^1_{i,j}\times PMP_{i1,j1}+c^2_{i,j}\times PMP_{i2,j2}+\ldots+c^n_{i,j}\times PMP_{in,jn}$$

where $c^0_{i,j}, \ldots, c'_{i,j}$ are predefined arithmetical coefficients.

In a second variant, optionally in combination with the preceding variant, the first step to calculate the value of one or more production parameters $PP_{i,j}$ of the product in relation to the value of one or more principal morphological parameters $PMP_{i,j}$, itself includes a first step to calculate the value of each morphological parameter $PM_{i,j}$ in relation to the value of at least one of the principal morphological parameters $PMP_{i,j}$, and a second step to calculate the value of one or more production parameters $PP_{i,j}$ of the product in relation to the value of at least one of the morphological parameters $PM_{i,j}$.

Preferably, the first step to calculate the value of each morphological parameter $PM_{i,j}$ in relation to the value of at least one of the principal morphological parameters $PMP_{i,j}$, then performs the following calculation for each morphological parameter $$PM_{i,j}=d^0_{i,j}+d^1_{i,j}\times PMP_{i1,j1}+d^2_{i,j}\times PMP_{i2,j2}+\ldots+d^n_{i,j}\times PMP_{in,jn}$$

where $d^0_{i,j}, \ldots, d^n_{i,j}$ are predefined arithmetical coefficients.

Also preferably, the second step to calculate the value of one or more production parameters $PP_{i,j}$ of the product in relation to the value of at least one of the morphological parameters $PM_{i,j}$ then performs the following calculation for each production parameter $PP_{i,j}$ of the product:

$$PP_{i,j}=e^{p,q}_{i,j}\times PM_{p,q}$$

where $e^{p,q}_{i,j}$ is a predefined arithmetical coefficient.

In another variant, optionally in combination with any one or more of the preceding variants, the product being intended to be worn on at least one part of the body of a given person, the selection of a given size from among the group of sizes includes determining the value of the characteristic principal morphological parameter(s) $PMP_{i,j}$ of that part of the body of this given person.

It also includes comparing the value of the characteristic principal morphological parameter(s) $PMP_{i,j}$ of the part of the body of this given person, with the respective limits of the variation intervals defining each of the sizes of the group of sizes.

It finally includes selecting the size, from among the group of sizes, which is defined by one or more variation intervals covering the respective values of the characteristic principal morphological parameter(s) $PMP_{i,j}$ of the part of the body of the given person.

In yet another variant, optionally in combination with any one or more of the preceding variants, the variation intervals of the product parameters $PP_{i,j}$ are defined with a tolerance equal to or less than ±4%, and preferably equal to 3%, around a median value.

In yet another variant, optionally in combination with any one or more of the preceding variants, the part of the body being the face, the morphological parameters are the biectocanthion distance, the biendocanthion distance, and the distance from the nasion to the subnasal point, whose respective definitions are recalled above.

Finally, in yet another variant, optionally in combination with any one or more of the preceding variants, the product is an item for sub-aquatic vision.

The invention can therefore be used advantageously to determine the size, from among a group of possible sizes, that will fit an individual person, through the provision of sizes based on a set of characteristic size parameters of the products which have a high level of morphological coverage.

The system is of relatively limited complexity and does not require extensive calculations, due in particular to the fact that the morphological parameters are reduced to a subset of principal morphological parameters, and a determination is made, by statistical study, of the arithmetical relationships between these parameters.

It is therefore particularly suitable for products whose geometry or morphology is not directly that of the part of the body on which these products are intended to be worn, as is the case, for example, for sub-aquatic vision products to be worn on the face, such as swimming goggles, and swimming or diving masks.

The system and the methods of the invention thus allow the establishment of a relationship between certain morphological characteristics of the product and certain morphological characteristics of the part of the body on which the product is to be worn, and determination of the size that will fit an individual person from among a group of possible sizes.

Other characteristics and advantages of the invention will become more clearly and fully apparent on reading the description that follows of preferred variants of embodiment of the system of the invention and of the method of implementation, given as non-limiting examples, with reference to the following appended drawings:

DETAILED DESCRIPTION OF THE INVENTION

The remainder of the description concerns a particular application of the system and methods of the invention to so-called sub-aquatic vision products, in particular to swimming goggles and masks as well as to diving masks. Evidently, the description of this application is given by way of example and therefore does not limit the invention. The invention extends to applications concerning any type of product that is intended to be worn on at least one part of the body.

Figure 1A:
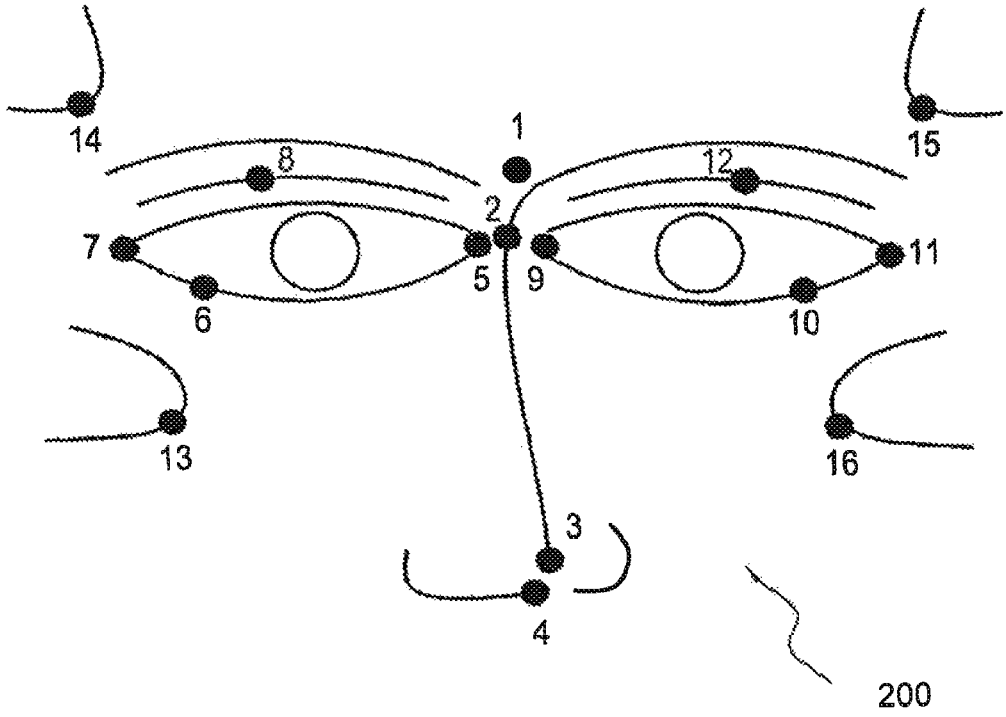
FIG. 1*a*: schematically shows the morphological markers in one variant of the invention.

On the basis of a morphological and anthropometric study, a certain number of morphological markers $M_i$, given in FIG. 1*a*, have been selected as being morphologically characteristic of a face 200.

The definition of these points is as follows:

$M_1$ is the median point of the frontal bone projecting outermost, located between the eyebrow arches, or the glabella.

$M_2$ is the median point located at the junction of the root of the nose and the forehead, or the nasion.

$M_3$ is the most anterior point of the tip of the nose, with the head being oriented in a so-called Frankfurt plane (the visual plane), or the pronasal.

$M_4$ is the point located to the apex of the angle formed by the lower edge of the septum and the top lip, or the subnasal.

$M_5$ is the first of the two points located at the internal (median) palpebral angles, outside of the lachrymal caruncles, or the first endocanthion.

$M_6$ is the first of the two points located at the localised break on the inferior structure of the orbita, at about one third of the distance from the first ectocanthion to the first endocanthion ($M_5$ to $M_7$), or the first sub-orbital.

$M_7$ is the first of the two points located at the external (lateral) palpebral angles on their posterior ridges, or the first ectocanthion.

$M_8$ is the first of the two median points located at the middle of the upper eyebrow arches and forming a break, or first suborbital.

$M_9$ is the second of the two points located at the internal (median) palpebral angles outside of the lachrymal caruncles, or the second endocanthion.

$M_{10}$ is the second of the two points located at the localised break in the inferior structure of the orbita, at about one third of the distance from the second ectocanthion to the second endocanthion ($M_9$ to $M_{11}$), or the second sub-orbital.

$M_{11}$ is the second of the two points located at the external (lateral) palpebral angles at their posterior ridge, or the second ectocanthion.

$M_{12}$ is the second of the two median points located at the middle of the upper eyebrow arches and forming a break, or the second sub orbital.

$M_{13}$ is the first of the two points forming kinds of flat spots located at the upper end of the junctions between the muscles of the jaw and the sub-orbital structures, or the first zygomatic bone.

$M_{14}$ is the first of the two points located above the lateral ends of the eyebrows, at the point where the temporal ridges undergo a slight variation in curvature (sometimes a point of inflection), or the first fronto-temporal.

$M_{15}$ is the second of the two points located above the lateral ends of the eyebrows, at the point where the temporal ridges undergo a slight variation in curvature (sometimes a point of inflection), or the second fronto-temporal.

$M_{16}$ is the second of the two points forming kinds of flat spots located at the upper end of the junctions between the muscles of the jaw and the sub-orbital structures, or the second zygomatic bone.

Figure 1B:
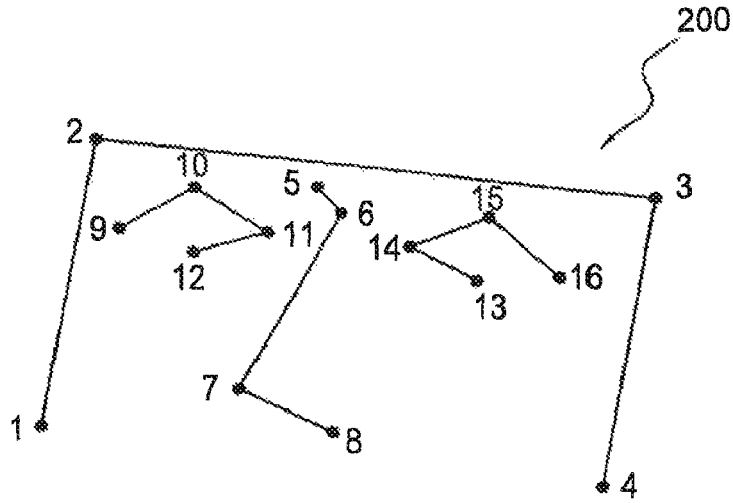
FIG. 1*b*: schematically illustrates the morphological markers in one variant of the invention, in a so-called false 3D illustration.

These morphological markers are illustrated in "false 3D" in FIG. 1*b*, in a different order. The points of FIG. 1*a* are renumbered in FIG. 1*b* in the following manner:

$M_1$: first zygomatic bone.
$M_2$: first fronto-temporal.
$M_3$: second fronto-temporal.
$M_4$: second zygomatic bone.
$M_5$: glabella.
$M_6$: nasion.
$M_7$: pronasal.
$M_8$: subnasal.
$M_9$: first ectocanthion.
$M_{10}$: first sub-orbital.
$M_{11}$: first endocanthion.
$M_{12}$: first sub-orbital.
$M_{13}$: second sub-orbital.
$M_{14}$: second endocanthion.
$M_{15}$: second sub-orbital.
$M_{16}$: second ectocanthion.

This order of the morphological markers $M_i$ facilitates modelling. It can effectively be performed in "a single process", and in an easily repeatable order.

From these morphological markers, morphological parameters $PM_{i,j}$ are defined, which are morphologically characteristic of a face 200, and which correspond to the distances between two morphological markers $M_i$, $M_j$. Thus, for example, $PM_{1,2}$ designates the distance from $M_1$ to $M_2$.

Figure 2:
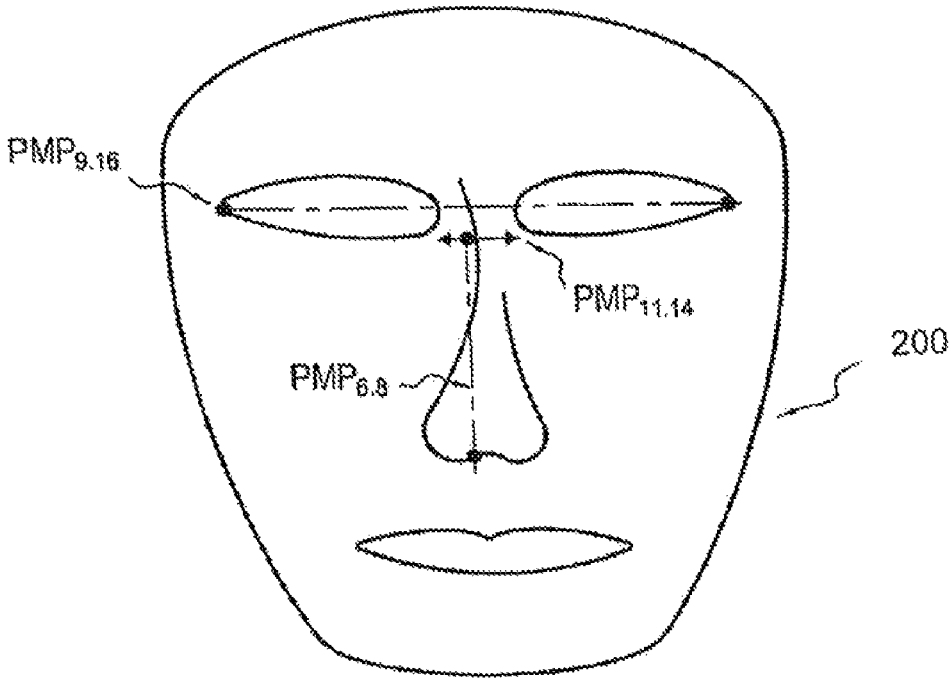
FIG. 2: is a schematic illustration of the principal morphological markers in one variant of the invention.

From statistical tests on samples representing different populations, corresponding to different morphological types, a subset of these morphological parameters $PM_{i,j}$ was selected. These parameters form principal morphological parameters $PMP_{i,j}$, and are illustrated FIG. 2.

These key parameters are those generating the greatest differentiation from one product to another. In particular, these parameters have a significant influence on comfort and leak resistance, when applied to items for sub-aquatic vision.

In this example, these principal morphological parameters are three in number:

$PMP_{9,16}=M_{9,16}$: the distance between the outer ends of the eyes or the biectocanthion distance.

$PMP_{11,14}=PM_{11,14}$: the distance between inner ends of the eyes or the bi-endocanthion distance.

$PMP_{6,8}=PM_{6,8}$: the height of the nose or the nasion to subnasal distance.

These three principal parameters are therefore used for identifying morphotypes. They are thus at the basis of the system and methods of the invention, in this example of application to items for sub-aquatic vision.

A matrix of coefficients $d^k_{i,j}$ is then determined, and is used to recalculate all the morphological parameters $PM_{i,j}$ from the subset of principal morphological parameters $PMP_{i,j}$.

Therefore, for example:

$$PM_{10,12}=d^0_{10,12}+d^1_{10,12}\times PMP_{9,16}+d^2_{10,12}\times PMP_{11,14}+d^3_{10,12}\times PMP_{6,8}$$

Through this reduction in the number of morphological parameters to a smaller number of principal morphological parameters, it is possible to simplify calculations and individual measurements to a considerable extent, since these measurements are limited to this number of principal morphological parameters.

Once identified and selected, the principal morphological parameters are used to represent the populations targeted by the system of the invention, in relation to these principal morphological parameters.

In the example in which the part of the body concerned is the face, FIGS. 5*a* to 5*d* schematically illustrate population ellipses according to two of the three principal morphological parameters.

Figure 5A:
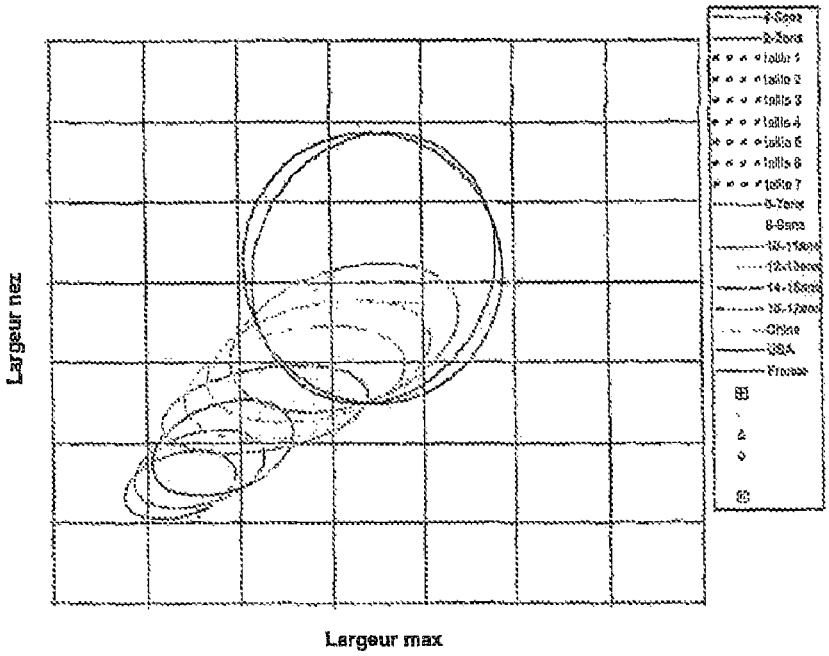
FIGS. 5*a* to 5*d*: schematically represent population ellipses according to two of the three principal morphological parameters, in the example in which the part of the body concerned is the face.

Thus, FIG. 5*a* shows the positioning of the population ellipses according to the width of the face and the width of the nose, and therefore according to principal morphological parameters $PMP_{9,16}$ and $PMP_{11,14}$.

Figure 5B:
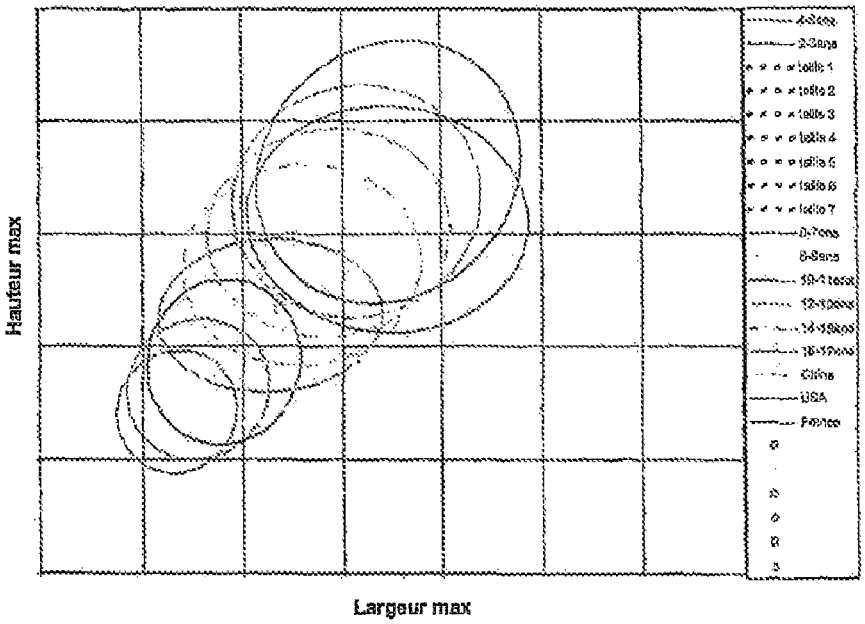

For its part, FIG. 5*b* shows the positioning of the population ellipses according to the width of the face and the height of the nose, and therefore according to principal morphological parameters $PMP_{9,16}$ and $PMP_{6,8}$.

From the graphs shown on FIGS. 5*a* and 5*b*, we create a system of sizes. Each size is determined by variation intervals of the principal morphological parameters. These intervals are defined around a mean or median value, with a tolerance around this value, using sensitivity tests based on comfort and waterproofing in the example of application to sub-aquatic optical products.

The aim is to obtain a system of sizes that allows a maximum rate of coverage of the different morphology types studied and identified, while still controlling the number of sizes by limiting them as much as possible, and by guaranteeing a high level of satisfaction on the part of the populations in relation to the comfort and waterproofing criteria in particular.

In a particular example, a rate of coverage of 90% has been obtained with a high satisfaction level.

By way of another example, table A below is a summary table of the intervals determining 7 sizes, and therefore used to cover 90% of the populations concerned, with high satisfaction level.

TABLE A

| | | Face width | Nose width | Nose height |
|---|---|---|---|---|
| Size 1 | ave. | 78.0 | 21.1 | 36.4 |
| | min. | 71.4 | 17.4 | 30.6 |
| | max. | 84.6 | 24.8 | 42.2 |
| Size 2 | ave. | 78.0 | 28.5 | 46.0 |
| | min. | 71.4 | 24.6 | 42.2 |
| | max. | 84.6 | 32.2 | 53.8 |
| Size 3 | ave. | 89.6 | 28.5 | 48.0 |
| | min. | 83.0 | 24.8 | 42.2 |
| | max. | 96.2 | 32.2 | 53.8 |
| Size 4 | ave. | 89.6 | 36.0 | 59.5 |
| | min. | 83.0 | 32.3 | 53.7 |
| | max. | 96.2 | 39.7 | 65.3 |

TABLE A-continued

| | | Face width | Nose width | Nose height |
|---|---|---|---|---|
| Size 5 | ave. | 101.2 | 48.0 | 36.0 |
| | min. | 94.6 | 42.2 | 32.3 |
| | max. | 107.8 | 53.8 | 39.7 |
| Size 6 | ave. | 101.2 | 59.5 | 28.5 |
| | min. | 94.6 | 5307 | 24.8 |
| | max. | 107.8 | 65.3 | 32.2 |
| Size 7 | ave. | 112.8 | 36.0 | 48.0 |
| | min. | 106.2 | 32.3 | 42.2 |
| | max. | 119.4 | 39.7 | 53.8 |

Figure 5C:
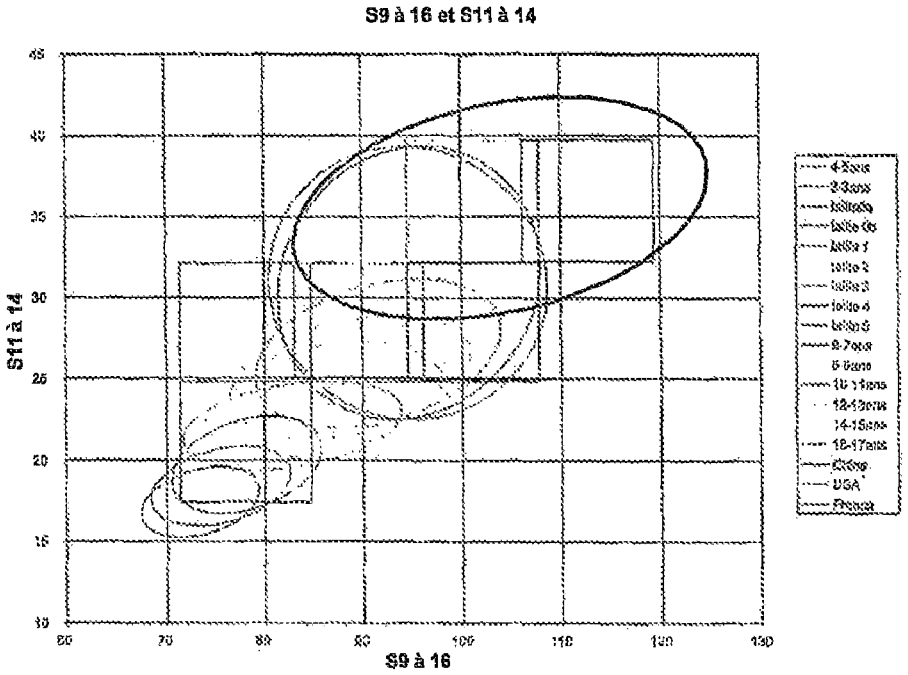

FIG. 5*c* constitutes a schematic representation of the system of sizes according to the width of the face and the width of the nose, and therefore according to principal morphological parameters $PMP_{9,16}$ and $PMP_{11,14}$.

Figure 5D:
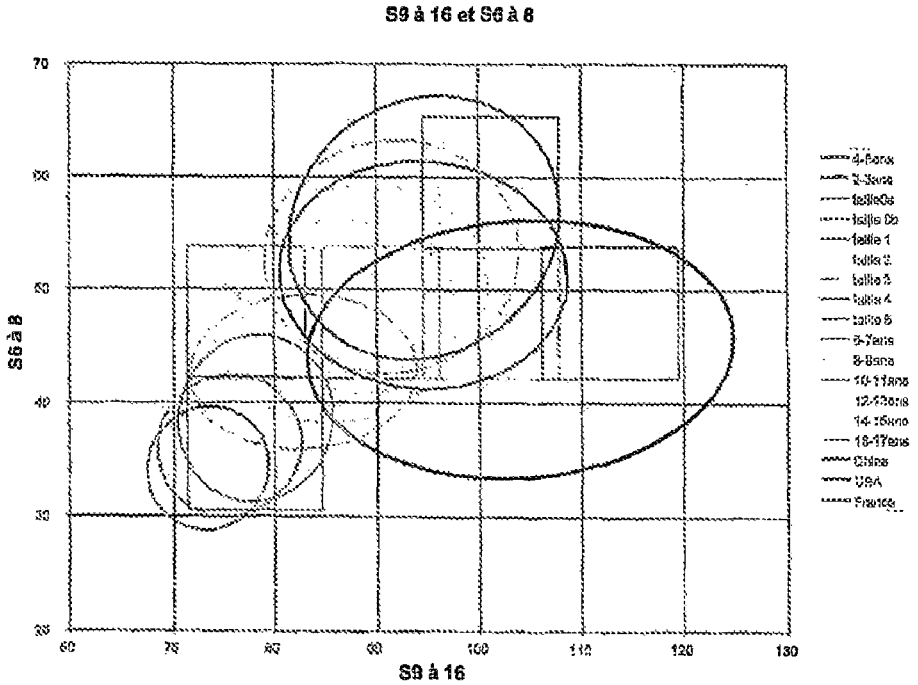

FIG. 5*d* constitutes a schematic representation of the system of sizes according to the width of the face and the height of the nose, and therefore according to principal morphological parameters $PMP_{9,16}$ and $PMP_{6,8}$.

We can therefore see on the graphs represented in these figures that the different population ellipses are correctly covered by the different sizes represented by squares centred on value pairs of the two principal morphological parameters, $PMP_{9,16}$ and $PMP_{11,14}$.

In a given size, and therefore in a given square, the size is considered to be ideal (very high satisfaction level) for a person for whom the values of the two principal morphological parameters, $PMP_{9,16}$ and $PMP_{11,14}$, correspond to the central point of the square. In a given size, and therefore in a given square, the further one is from the centre, the more the level of satisfaction reduces, while still remaining acceptable.

Next, for each product, points $NP_i$ are selected, which are geometrically characteristic of this product.

Figure 3A:
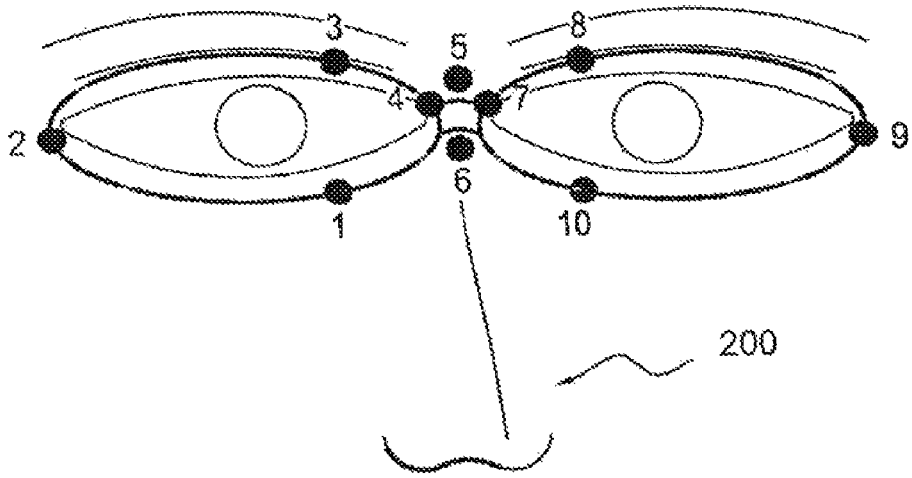
FIG. 3*a*: schematically illustrates the characteristic geometrical points of a first type of product.
Figure 3B:
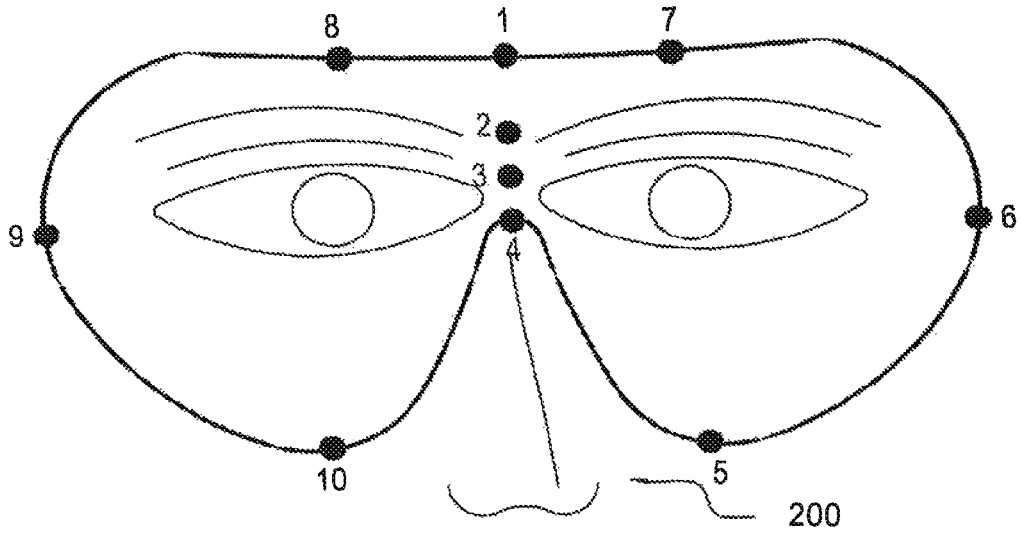
FIG. 3*b*: schematically illustrates the characteristic geometrical points of a second type of product.
Figure 3C:
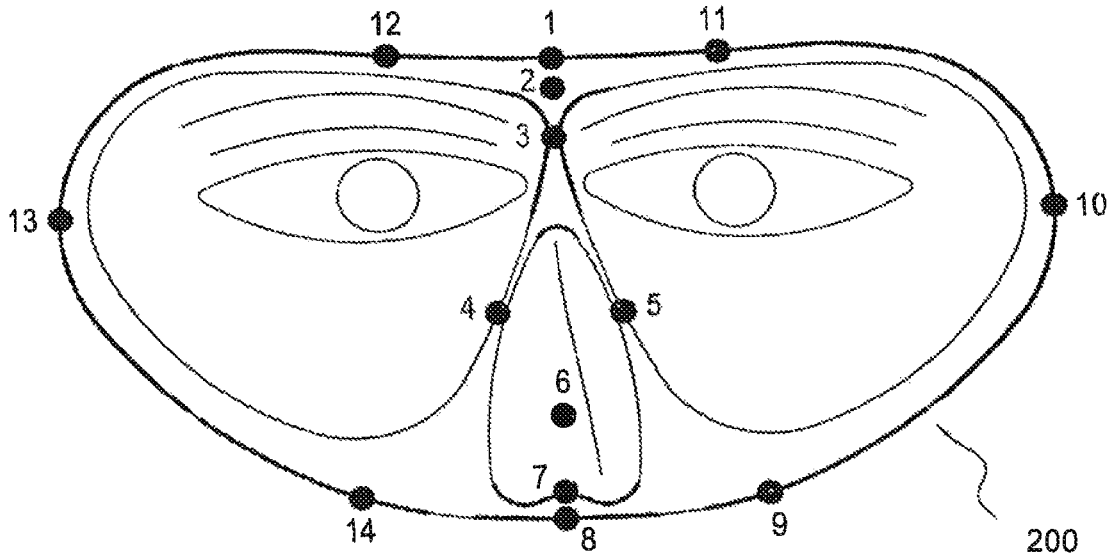
FIG. 3*c*: schematically illustrates the characteristic geometrical points of a third type of product.

These geometrically characteristic points $NP_i$ are shown FIGS. 3*a*, 3*b* and 3*c*, in the three examples of swimming goggles, swimming mask and diving mask respectively.

These geometrically characteristic points $NP_i$ of each product are used to determine product parameters $PP_{i,j}$, which correspond to the distances between two points, $NP_i$ and $NP_j$. Thus, for example, $PP_{1,2}$ indicate the distance from $NP_1$ to $NP_2$.

In each of the three cases represented respectively in FIGS. 3*a* to 3*c*, a certain number of tests are then used to link each of the product parameters $PP_{i,j}$ to at least one morphological parameter $PM_{i,j}$ using an arithmetical relationship of the type $PP_{i,j}=e^{p,q}_{i,j}\times PM_{p,q}$ Also, a point $NP_{ref}$ is chosen from among points $NP_i$, as the centre of a reference system in which the coordinates ($x_i$, $y_i$, $z_i$) of each point $NP_i$ can be expressed.

The aforementioned tests are also used to link these coordinates ($x_i$,$y_i$,$z_i$) to one or more product parameters $PP_{i,j}$.

We are therefore now in possession of the information necessary for the manufacture of a product of a given size, namely the coordinates ($x_i$, $y_i$, $z_i$) and the distances $PP_{i,j}$.

Additionally a link is available firstly between the principal morphological parameters $PMP_{i,j}$ and morphological parameters $PM_{i,j}$, and secondly between morphological parameters $PM_{i,j}$ and product parameters $PP_{i,j}$.

It can therefore be said that a link is available between the principal morphological parameters $PMP_{i,j}$ and the product parameters $PP_{i,j}$. This link is therefore of the form:

$$PP_{i,j}=c^0_{i,j}+c^1_{i,j}\times PMP_{9,16}+c^2_{i,j}\times PMP_{11,14}+c^3_{i,j}\times PMP_{6,8}$$

where $c^k_{i,j}$ are statistically determined coefficients, or:

$$PP_{i,j}=c^0_{i,j}+c^1_{i,j}\times PMP_{9,16}+e^{11,14}_{i,j}\times d_{i,j}{}^2+PMP_{11,14}+e^{6,8}_{i,j}\times d^3_{i,j}\times PMP_{6,8}$$

Thus, by determining the values of the principal morphological parameters $PMP_{i,j}$ of a person by direct measurement on this person for example, it is possible to deduce the values of the product parameters $PP_{i,j}$ corresponding to this given person.

It is then possible to produce a "tailor-made" product for the person concerned.

For a product range comprising several sizes, for example seven sizes as shown in the table in Graph C, it is also possible to determine the appropriate size for this given person, by comparing measured values of the principal morphological parameters $PMP_{i,j}$ of this person with the limit values of the intervals determining each size.

By means of the link explained above, between the principal morphological parameters $PMP_{i,j}$ and the product parameters $PP_{i,j}$, the sizes can just as well be determined using the variation intervals of the different product parameters $PP_{i,j}$, each centred on a mean or median value corresponding to the value of the associated product parameter. These intervals are then preferably determined with a tolerance equal to ±3% around the median value, and at all events equal to or less than ±4% around this median value.

As explained above, the preliminary study, used for size grading, ensures a maximum rate of coverage of the different morphology types studied and identified, whilst controlling the number of sizes by limiting their number as much as possible, and guaranteeing a high level of satisfaction by populations for comfort and leak resistance criteria in particular.

Figure 4:
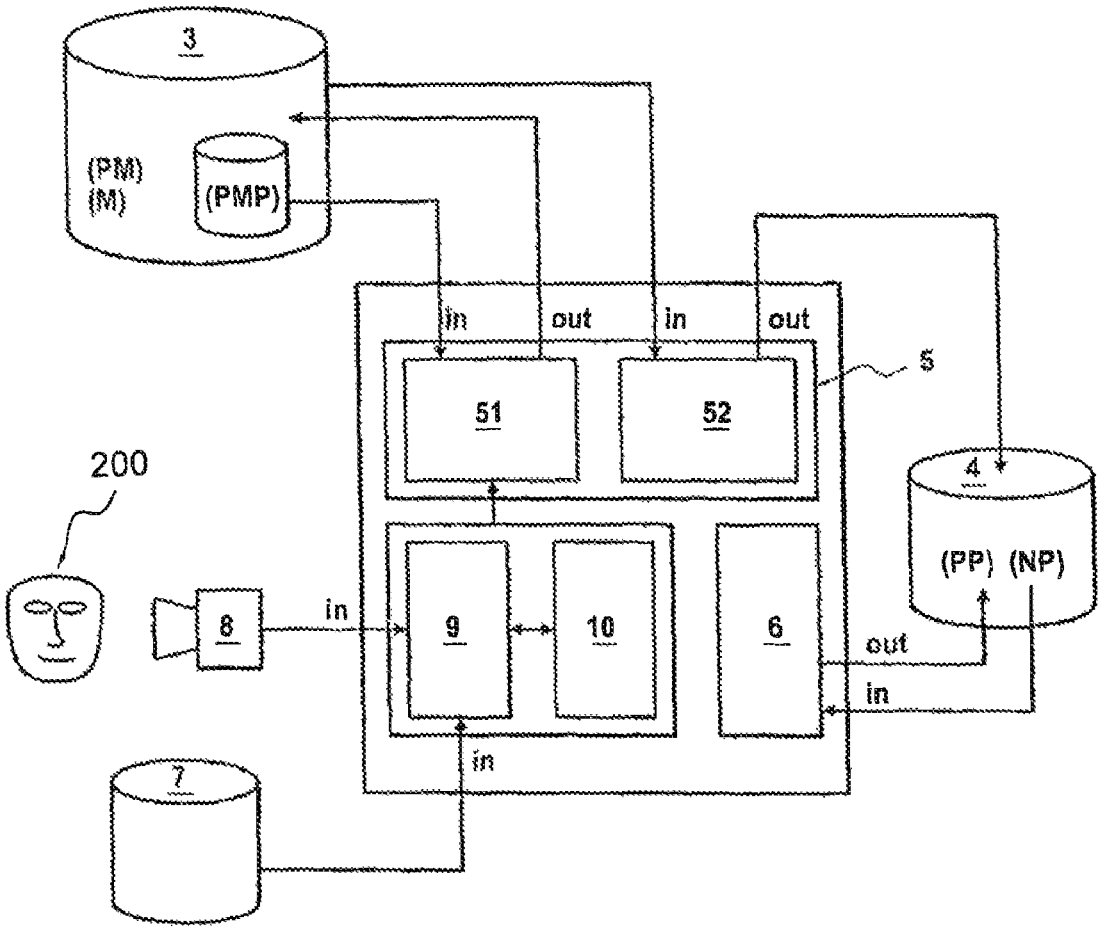
FIG. 4: schematically represents the system in one variant of the invention.

FIG. 4 schematically illustrates the system in one variant of the invention.

This system includes storage means 3 that can be used to store the definition of the morphological markers Mi and morphological parameters $PM_{i,j}$, and the values of these parameters $PM_{i,j}$. Among these, a subset forms the subset of principal morphological parameters $PMP_{i,j}$.

The system also includes storage means 4 to store the definition of the characteristic points $NP_i$ of the product (optionally including their coordinates in a reference system centred on a particular point $NP_{ref}$), product parameters $PP_{i,j}$ and the values of these parameters $PP_{i,j}$.

Additionally, the different sizes and their respective definitions, namely the variation intervals of the values of the principal morphological parameters $PMP_{i,j}$ or of the product parameters $PP_{i,j}$, are stored in storage means 7.

A processing device includes a module 5 that can be used to calculate the values of the product parameters $PP_{i,j}$ in relation to the values of the principal morphological parameters $PMP_{i,j}$.

Advantageously, this module 5 includes two sub-modules 51, 52.

The first sub-module 51 is initially used to calculate the value of the morphological parameters $PM_{i,j}$ in relation to the values of the principal morphological parameters $PMP_{i,j}$.

The second sub-module 52 is then used to calculate the value of the product parameters $PP_{i,j}$ in relation to the values of the morphological parameters $PM_{i,j}$ calculated by the first sub-module 51.

With said system, it is therefore possible to manufacture a tailor-made product adapted to fit a given person, or to select the size that fits this given person from among all the sizes available, provided that the values are known of the principal morphological parameters $PMP_{i,j}$ of the part 200 of the body of the person concerned.

These values, if known beforehand, can be entered into the system using conventional data entry means, and can then be processed by comparison means 9 as explained below.

These values can also be determined using determination means 8 that use conventional biometric measurement techniques. It is possible, for example, to envisage the use of a photographic appliance associated with processing and measurement software. It is also possible to envisage the use of light fringes reflected by a mirror onto the part 200 of the body of the person, associated with a device for detection of these light and measurement fringes.

These values are then transmitted to the comparison means 9. These means are able to transmit the same directly to the calculation module 5 in order to determine the values of the corresponding product parameters $PP_{i,j}$, for manufacture of a tailor-made product for example. It is also able to consult the storage means 7 memorizing the respective definitions of each available size, and then to transmit this data to the selection means 10 which select the corresponding size, namely the size determined by variation intervals of the principal morphological parameters $PMP_{i,j}$ covering the respective values of these different principal morphological parameters $PMP_j$ relating to part 200 of the body of the given person.

It is noted here that the entirety of the foregoing description is given by way of example, and therefore does not limit the invention.

In particular, the different storage means 3, 4, 7 are illustrated separately. This separation is merely a logic illustration however, and is not physical, which means that they can therefore be brought together physically in a single storage means such as a file or a database for example.

This also applies to the different modules or sub-modules 5, 51, 52, 6 or to the various means 9, 10. Their illustration as separate modules or means is only a logic illustration of the architecture and arrangement of these modules or means, and they can therefore be brought together physically in a single means or module comprising a processor or a processing unit for example and several computer programs for example.

The invention claimed is:

1. A sizing system of the grading type, which can be used in particular to determine one or more sizes, for a product intended to be worn on at least one part of the body, the product presenting pre-selected geometrically characteristic points, the part of the body presenting pre-selected characteristic morphological markers comprising:

a means for storage of respective values of one or more characteristic morphological parameters ($PM_{i,j}$) corresponding to a distance between two characteristic morphological markers ($M_i$, $M_j$) of said part of the body, at least one of said characteristic morphological parameters ($PM_{i,j}$) being a principal morphological parameter ($PMP_{i,j}$);

a means for storage of the respective values of one or more geometrically characteristic product parameters ($PP_{i,j}$) corresponding to a distance between two geometrically characteristic points ($NP_i$, $NP_j$) of said product;

a first module for calculating a value of each characteristic product parameter ($PP_{i,j}$) according to the value of at least one of said principal morphological parameters ($PMP_{i,j}$);

a second module for calculating the value of coordinates of each geometrically characteristic point ($NP_i$) of said product according to at least one of said geometrically characteristic product parameters ($PP_{i,j}$), said coordinates being expressed in a reference system centered on a particular point ($NP_{ref}$) from among said geometrically characteristic points ($NP_i$) of said product, a means for storing at least one sized determined by respective particular variation intervals of said principal morphological parameter or parameters ($PMP_{i,j}$), or by respective particular variation intervals of said geometrically characteristic product parameter or parameters ($PP_{i,j}$), and wherein said first calculation module is designed to perform the following calculation for each geometrically characteristic product parameter ($PP_{i,j}$):

$$PP_{i,j}=c^0_{i,j}+c^1_{i,j}\times PMP_{i1,j1}+c^2_{i,j}\times PMP_{i2,j2}+\ldots+c^n_{i,j}\times PMP_{in,jn}$$

where $c^0_{i,j}, \ldots c^n_{i,j}$ are predetermined arithmetical coefficients, and where i,j and n are integers.

2. A system according to claim 1, wherein said first module for calculating the value of each product parameter ($PP_{i,j}$) according to the value of at least one of said principal morphological parameters ($PMP_{i,j}$) includes:

a first sub-module for calculating the value of each characteristic morphological parameter ($PM_{i,j}$) according to the value of at least one of said principal morphological parameters ($PMP_{i,j}$)

a second sub-module for calculating the value of each geometrically characteristic product parameter ($PP_{i,j}$) according to the value of at least one of said characteristic morphological parameters ($PM_{i,j}$).

3. A system according to claim 2, wherein said first calculation sub-module is designed to perform the following calculation for each characteristic morphological parameter ($PM_{i,j}$):

$$PM_{i,j}=d^0_{i,j}+d^1_{i,j}\times PMP_{i1,j1}+d^2_{i,j}\times PMP_{i2,j2}+\ldots+d^n_{i,j}\times PMP_{in,jn}$$

where $d^0_{i,j}, \ldots, d^n_{i,j}$ are predetermined arithmetical coefficients, and where i, j and n are integers.

4. A system according to claim 2, wherein said second calculation sub-module is designed to perform the following calculation for each geometrically characteristic product parameter ($PP_{i,j}$):

$$PP_{i,j}=e^{p,q}_{i,j}\times PM_{p,q}$$

where $e^{p,q}_{i,j}$ is a predetermined arithmetical coefficient, and where p and q are integers.

5. A system according to claim 1, further comprising:

means for determining the value of said principal morphological parameters ($PMP_{i,j}$), means for comparing the value of the said principal morphological parameter or parameters ($PMP_{i,j}$), with respective boundaries of the said variation intervals determining each of said sizes of said set of said sizes stored in said storage means, means for selecting the size, from among said set of said sizes stored in said storage means, which is determined by one or more variation intervals to which belong the respective values of said principal morphological parameters ($PMP_{i,j}$).

6. A system according to claim 1, wherein said variation intervals of said geometrically characteristic product parameters ($PP_{i,j}$) are defined with a tolerance that is less than or equal to 4%, and preferably less than or equal to 3%.

7. A system according to claim 1, wherein said part of the body is a face and said principal morphological parameters ($PMP_{i,j}$) are a bietocanthion distance, a biendocanthion distance, and a distance from a nasion to a subnasal point.

8. A system according to claim 1, wherein said product is a subaquatic optical product.

9. A sizing method of the grading type, which can be used to determine one or more sizes for a product intended to be worn on at least one part of the body, the product presenting pre-selected geometrically characteristic points, the part of the body presenting pre-selected characteristic morphological markers comprising the steps of:

providing a step for the selection, from a means of storage, of one or more principal morphological parameters ($PMP_{i,j}$) from among one or more characteristic morphological parameters ($PM_{i,j}$) stored in said means of storage, and corresponding to a distance between two characteristic morphological markers ($M_i$, $M_j$) of said part of the body;

providing a first calculation step, by a first calculation module, of a value of one or more production parameters ($PP_{i,j}$) of the product, corresponding to a distance between two geometrically characteristic points ($NP_i$, $NP_j$) of said product, according to respective values of one or more of the said principal morphological parameters ($PMP_{i,j}$) of said part of the body, providing a second calculation step, by a second module, of a value of coordinates of each geometrically characteristic point ($NP_i$) of said product, according to respective values of one or more production parameters ($PP_{i,j}$) of the product, said coordinates being expressed in a reference system centered on a point ($NP_{ref}$) from among said geometrically characteristic pints ($NP_i$) of said product, providing a step for determining said respective values of said principal morphological parameters ($PMP_{i,j}$) by:

i. selecting from a means for storing a given size, from among a set of sizes determined by respective variation intervals of said principal morphological parameters ($PMP_{i,j}$), ii. assigning a median value of each of said variation intervals determining said given size to each of corresponding principal morphological parameters ($PMP_{i,j}$), and wherein for each production parameter ($PP_{i,j}$) of said product, said first calculation step includes;

performing the following calculation:

$$PP_{i,j}=c^0_{i,j}+c^1_{i,j}\times PMP_{i1,j1}+c^2_{i,j}\times PMP_{i2,j2}+\ldots+c^n_{i,j}\times PMP_{in,jn}$$

where $c^0_{i,j}, \ldots c^n_{i,j}$ are predetermined arithmetical coefficients, and where i,j and n are integers.

10. A method according to claim 9, wherein said first step of calculating the value of one or more production parameters ($PP_{i,j}$) of the product according to the value of one or more principal morphological parameters ($PMP_{i,j}$), further includes:

providing a first calculation step, using a first sub-module for calculating the value of each of characteristic morphological parameters ($PM_{i,j}$) according to the value of at least one of said principal morphological parameters ($PMP_{i,j}$), providing a second calculation step, using a second sub-module for calculating the value of one or more production parameters ($PP_{i,j}$) of said product according to the value of at least one of said morphological parameters ($PM_{i,j}$).

11. A method according to claim 10, wherein said first step for calculating the value of each of characteristic morphological parameters ($PM_{i,j}$) according to the value of at least one of said principal morphological parameters ($PMP_{i,\ j}$), further includes the step of;

performing the following calculation for each morphological parameter ($PM_{i,j}$):

$$PM_{i,j}=d^0_{i,j}+d^1_{i,j}\times PMP_{i1,j1}+d^2_{i,j}\times PMP_{i2,j2}+\ldots+d^n_{i,j}\times PMP_{in,jn}$$

where $d^0_{i,j}$, $d^n_{i,j}$ are predetermined arithmetical coefficients, and where i, j and n are integers.

12. A method according to claim 10, wherein said second step for calculating the value of one or more production parameters ($PP_{i,j}$) of said product according to the value of at least one of the said characteristic morphological parameters ($PM_{i,j}$) further includes the step of;

performing the following calculation for each production parameter ($PP_{i,j}$) of said product:

$$PP_{i,j}=e^{p,q}_{i,j}\times PM_{p,q}$$

where $e^{p,q}_{i,j}$ is a predetermined arithmetical coefficient, and where p and q are integers.

13. A method according to claim 9, wherein said selection of a given size from among said set of sizes includes:

determining, by determination means, the value of said principal morphological parameters ($PMP_{i,j}$) of said part of the body of a person, comparing, by comparison means, the value of said principal morphological parameters ($PMP_{i,j}$), with respective boundaries of said variation intervals determining each of said sizes of said set of sizes, selecting, by selection means, the size from among said set of said sizes, which is determined by one or more variation intervals to which belong the respective values of said principal morphological parameters ($PMP_{i,j}$).

14. A method according to claim 9, wherein said variation intervals of said production parameters ($PP_{i,j}$) are defined with a tolerance that is less than or equal to 4%, and preferably less than or equal to 3%.

15. A method according to claim 9, wherein said part of the body is a face and said morphological parameters ($PMP_{i,j}$) are a biectocanthion distance, a biendocanthion distance, and a distance from a nasion to a subnasal point.

16. A method according to claim 9, wherein said method produces a subaquatic optical product.

* * * * *